United States Patent [19]

Britt

[11] 4,083,535

[45] Apr. 11, 1978

[54] PORTABLE FENCE

[76] Inventor: James O. Britt, Westmoreland Rd., Whitesboro, N.Y. 13492

[21] Appl. No.: 736,370

[22] Filed: Oct. 28, 1976

[51] Int. Cl.[2] ..... E04H 17/16

[52] U.S. Cl. ..... 256/24; 256/73; 256/DIG. 2

[58] Field of Search ..... 256/24, 25, 26, 1, 73, 256/DIG. 2

[56] References Cited

U.S. PATENT DOCUMENTS 3,291,453 12/1966 Dashio ..... 256/1

3,341,180 9/1967 Dashio ..... 256/1

3,346,238 10/1967 Dashio ..... 256/2 H

*Primary Examiner*—Andrew V. Kundrat

*Attorney, Agent, or Firm*—James J. Brown

[57] ABSTRACT

A fence structure is disclosed in which rectangular panels are removably mounted on tracks between vertical upright posts. The tops of the panels overlap and interlock in such a way that an entire section of panels is secured by locking in place a single panel. Means are provided for maintaining the panels in a partially raised position or they can be completely removed from between the vertical posts.

7 Claims, 6 Drawing Figures

PORTABLE FENCE

BRIEF STATEMENT OF THE INVENTION

The present invention is concerned with a fence structure having a plurality of spaced vertical posts with flat, rectangular panels mounted between each pair of posts in such a way that the panels can be either easily raised to an intermediate position or completely removed from between the posts. The present invention is further characterized in that the horizontal top members of each panel overlap and interlock with one another to form a continuous surface which extends across the entire top of the fence structure thereby permitting the individual panels to be secured by locking in place a single panel.

THE PRIOR ART

The following U.S. patents, while relevant, do not disclose or suggest the present invention: U.S. Pat. Nos. 3,883,120; 3,770,245; 3,698,692; 3,304,683.

BACKGROUND OF THE INVENTION

Typical fencing which is commonly employed in the art suffers from the disadvantage that the structures involved are usually of a permanent nature or at least sufficiently complex in structure that they cannot be readily or easily assembled. Thus, a typical fence structure normally requires the extensive efforts of at least several workman to install even after the necessary upright posts are in place since various cross pieces and other members must be individually nailed or bolted in place. Further, once such structures are erected it is not generally feasible to take them down, for example, for painting or other maintenance. Even those fence structures which have employed prefabricated center panels erected between center posts have not provided any way in which the panels could be easily raised or removed without essentially disassembling the entire structure. Clearly, one reason why fences have been constructed in this manner is that when one wishes to enclose an area with a fence one does not wish it to be disassembled easily by an unauthorized individual. In other words the concept of a fence which can easily and quickly be disassembled has appeared to be at variance with the requirements of a fence which provides a reasonably secure structure.

Nevertheless, there is a great advantage in a fence which can be easily and quickly installed by a single individual without any particular specialized training or skill and which at the same time can be partially or totally disassembled if required. Such a fence must however, also retain the quality of being a relatively secure structure which cannot easily be removed or disassembled by the unauthorized or unwanted individual. The advantages to such a structure in addition to being less time consuming and expensive to install are clear in that maintenance on the structure is greatly simplified. Further, such a structure would have the advantages of permitting grass or other vegetation to be easily removed from around it on a regular basis by simply raising the fence panels or of allowing large vehicles or machinery to pass through by temporarily removing a section of the fence.

OBJECTS OF THE INVENTION

Accordingly, it is an object of the present invention to provide a fence structure which can be easily assembled by a single individual without any necessity for special skills or training.

It is a further object of the present invention to provide a simplified fence structure which permits the panels which are vertically disposed between the fence posts to be easily and quickly raised to an intermediate position or fully removed as required in order to facilitate maintenance and repair or other use as well as the removal of vegetation from around the fence.

Yet a further object of the present invention is to provide a fence structure having removable panels disposed between the posts in such a way that the top horizontal members of each panel interlock to form a continuous top piece which can be secured at a single point to prevent the unauthorized raising of any of the individual panels of the fence.

DESCRIPTION OF THE INVENTION

These and other objects are accomplished according to the present invention whereby a fence structure is provided having a plurality of spaced, vertical posts with a flat rectangular panel removably mounted vertically between each adjacent pair of the posts. The opposing sides of each pair of posts are provided with vertical slots which are adapted to receive guide members mounted on the opposing vertical sides of each of the panels. The horizontal top piece of each of the panels extends horizontally beyond the vertical sides of the panels and interlocks with the corresponding top piece of the adjacent panel so that it forms a continuous interlocking surface extending across the entire top of the fence structure thereby preventing any panel from being raised until the adjacent panel whose interlocking top piece overlaps the top piece of the first panel is lifted. Thus, the panels must be raised sequentially with the first panel raised being a terminal panel whose top member is not overlapped by the adjacent interlocking top members. Such a terminal panel could, therefore, have a top member which interlocks only with the adjacent top piece that it overlaps or a top piece which overlaps both of the adjacent top pieces on either side of it. Additionally, means are provided on the vertical sides of each panel to engage the adjacent posts in order to maintain the panel in a partially raised position between the posts.

Thus, installation of the fence structure of the present invention is accomplished by simply installing the spaced vertical posts in a pre-arranged fashion and then sliding the rectangular panel members into place in the proper sequence so that their top members engage one another in an interlocking manner as described above. When it is desired to remove the panels, for example, for painting or maintenance or to permit a large vehicle to pass through, this is simply accomplished by removing a bolt or other means which secures the terminal locking panel and then one by one removing the remaining panels in sequence. Alternatively, the panels can be easily reaised to an intermediate position to permit grass or other vegetation to be removed from beneath them and then readily returned to their original position.

DESCRIPTION OF THE DRAWINGS

The various features and embodiments of the present invention will, however, be better understood by having reference to the drawing contained herein which illustrate a preferred embodiment of the present invention.

Figure 1:
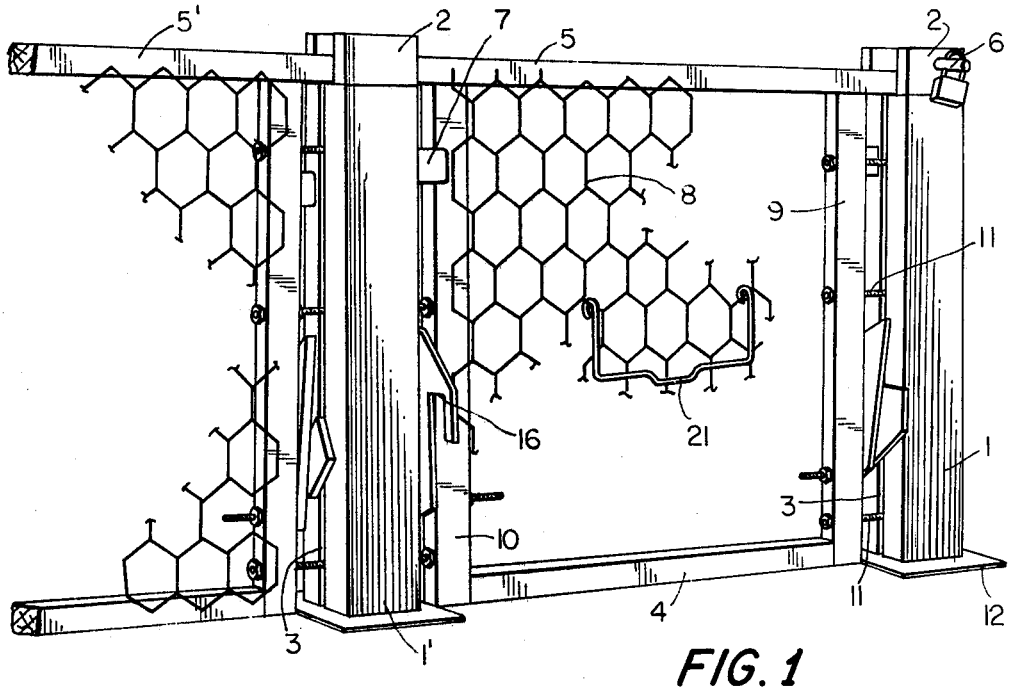
FIG. 1 shows two adjoining sections of the fence structure of the present invention with the panels lowered and secured in place.

With specific reference to FIG. 1 of the drawings it will be seen that the vertical posts 1 and 1' are shown between which is vertically mounted a panel having side members 9 and 10 bottom member 4 and top member 5 which extend on either side beyond the two vertical side members. A wire screen is shown at 8 although it will be appreciated that any suitable fence material such as slats, pickets or other materials could as well be employed. Each of the vertical posts 1 and 1' is provided with a slotted top piece 2 which is adapted to receive the extending portion of the horizontal top member 5 of the panel. Each of the vertical posts 1 and 1' is also provided on its opposing side with a slot 3 which is adapted to receive the guide members 11. A pivoted, notched stop means 16 is attached to either side of the panel and engages projection 7 when the panel is partially raised vertically. To facilitate such a raising a handle is shown attached to the wire screen of the panel. In the embodiment of the invention depicted herewith a plate 12 is also provided around the base of the posts to prevent vegetation from growing closely around the post. A bolt 16 and lock are shown securing the panel in its down position.

Figure 2:
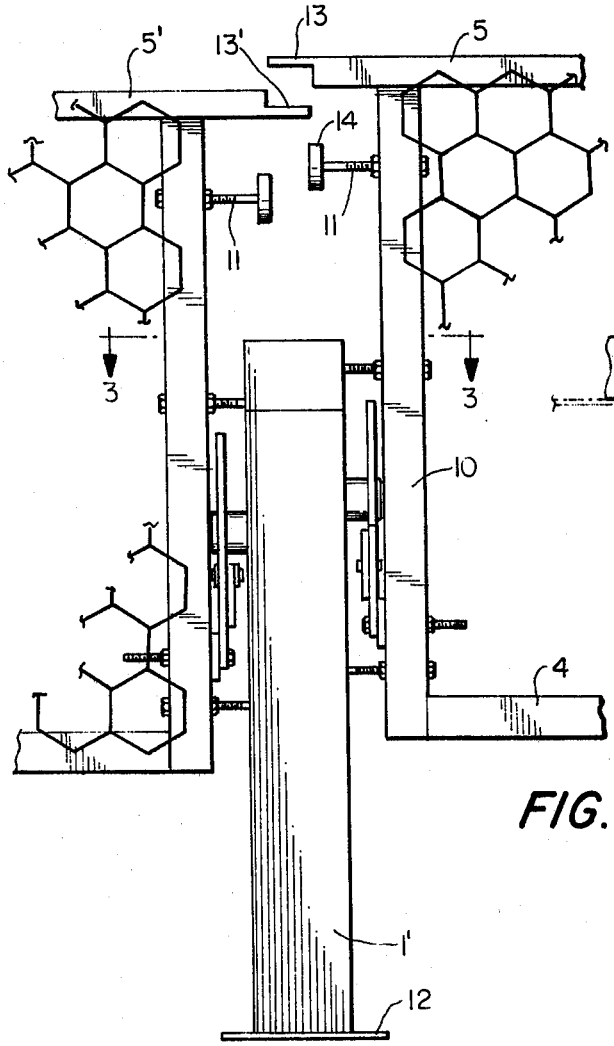
FIG. 2 shows portion of two panels engaging a single post in a raised position.

With reference to FIG. 2 which shows the respective panels in raised position, it will be seen that the horizontal top members 5 and 5' have interlocking end portions 13 and 13' which engage one another so that the top member 5' cannot be raised without first raising the overlapping member 5. In other words, once the panel to which the top piece 5' is attached is lowered in place with the extending portion of the top member resting in the slotted top 2 of the post and the extending portion 13 of top piece 5 overlapping and engaging it, that panel cannot be raised without first raising the panel to which the top piece 5 is attached, and this panel is in turn secured in place by the bolt 6 which passes through the slotted post top 2.

Figure 3:
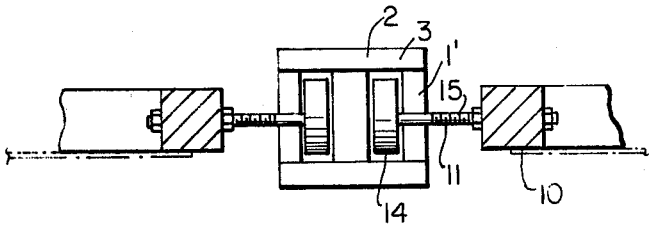
FIG. 3 is an overhead view showing the guide members of two panels in place in the slots on either side of the vertical upright post.
Figure 4:
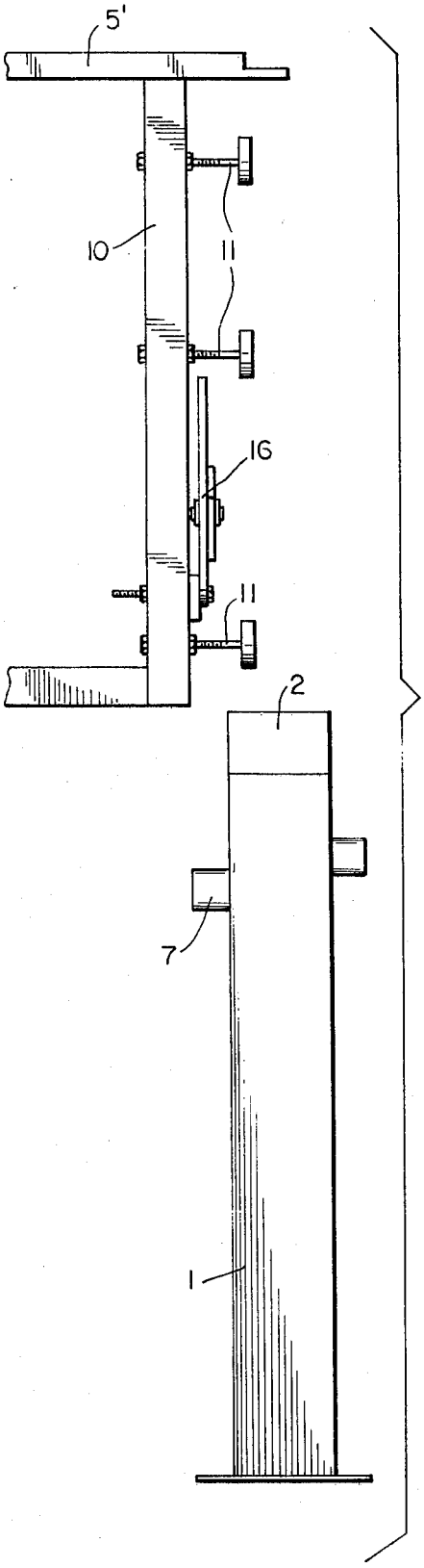
FIG. 4 shows an upright post and a portion of one raised panel with the guide members and stop means illustrated.

FIG. 3 illustrates a preferred arrangement whereby the guide members 11 are disposed on the sides 9 and 10 of the panel and terminate in rollers 14 which are disposed in the T-shaped channel 3 of the post 1'.

Figure 6:
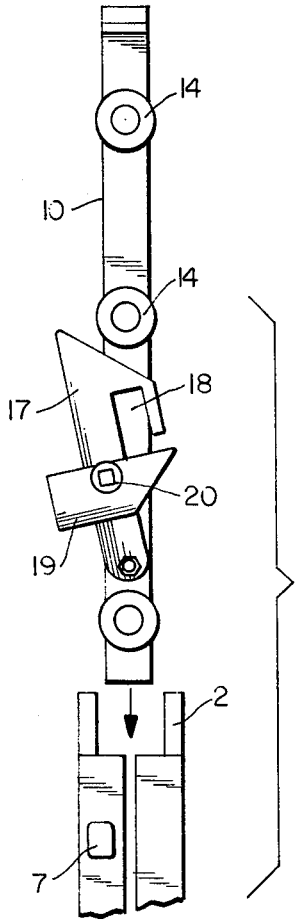
FIG. 6 illustrates in detail the stop means disposed on one side of a rectangular panel.

Stop means are conveniently provided on either or both sides of each frame to permit the frame to be raised partially such as for example when it is desired to remove undergrowth. FIG. 6 shows a preferred arrangement of such stop means whereby an inverted latch 17 is pivotally attached to the side member 10 of the panel and additional cross member 19 is pivotally attached to the latch member 17 at 20. By virture of the wedge-shaped top portion of the latch 17, when the panel is raised the angled top surface of latch 17 engages a stop means 7 of the post 1 thereby causing the latch member to pivot out of the way as the panel is raised. On lowering the panel, however, the crossmember 19 first engages the stop 7 and causes the entire latch member 17 to be pivoted back into position so that the recessed portion 18 of the latch surrounds and engages the stop 7 thereby preventing the panel from decending further. Of course when it is desired to lower the panel all the way back down, the panel is raised a short distance so that the recessed portion of the latch and the stop means are disengaged and the panel can then be lowered past the stop means.

Figure 5:
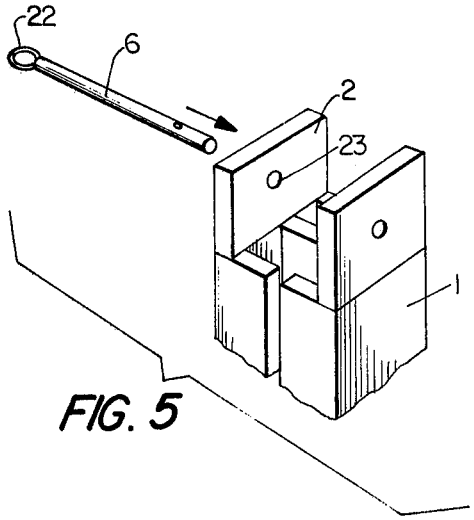
FIG. 5 illustrates the top of one of the vertical posts showing the slots for receiving the extended top member of the panels and the pin for securing the panels in place.

FIG. 5 shows the top of the slotted posts 1 of the present invention with the slotted top 2 to accommodate the horizontal top extention of the frames. Holes are provided at 23 to receive the bolt 6 which, when in place, keeps the panels from being raised. A ring is provided at 22 to keep the pin from sliding all the way through the holes and a hole is shown at the other end of the eye to accommodate a lock which thereby serves to keep the entire fence secured.

It will of course, be understood that although a preferred embodiment of the present invention is shown and described herein, many variations and embodiments are included within the scope of this invention. For example, the fence itself can be constructed of any suitable materials such as are generally employed in the construction of fences. Typically for example, wood or metal fence post and frames could advantageously be employed. Additionally, as already noted, the actual material used for each panel can vary widely and can include screen, wire or slats of different materials. While the posts shown herein have a generally rectangular cross section, they can also be constructed having different cross sections as long as they are adapted to receive guide members disposed on the sides of the panels and the extended horizontal top members. Further, while it is preferred and clearly more advantageous that the extended horizontal top member engage one another in the manner described so that the entire structure can be secured by a single pin or bolt located in the top of one of the posts, an alternative procedure would be to secure each individual post or alternative posts with their bolts thereby making it possible to raise individual panels without disturbing the other panels in the row. Also, rather than having a series of alternating overlapping top members which are ultimately secured by the final top member in a row, it may be advantageous in some situations to occasionally locate a panel having a top member whose extending portion overlaps on both sides so as to be capable of being independently raised thereby freeing the panels on either sides to also be raised.

It should be appreciated by those skilled in the art, however, that other modifications and embodiments of the device as described herein fall within the scope of the present invention.

It is claimed:

1. A fence structure comprising pairs of spaced, vertical posts with a flat rectangular panel having a top, bottom and two opposing vertical sides removably mounted vertically between each adjacent pair of said posts; the opposing sides of said posts having vertical slots running substantially the length thereof and adapted to receive guide members mounted on opposing vertical sides of each of said panels; the top, horizontal side of each of said panels extending horizontally beyond the vertical sides of the panel to engage and interlock respectively with the corresponding top extension of each adjacent panels so as to form a continuous interlocking means extending across the entire top of the fence structure for preventing any panel from being raised until the panel adjacent on one side thereof whose top is in overlapping engagement with the extending top thereof is first raised, each of said vertical posts having an open slotted portion at its top which accommodates the overlapping and interlocking portions of said extending top sides and stop means mounted on one vertical side of each panel which engage the adjacent side of one post to maintain said panel in a raised position once it has been raised by sliding between the posts.

2. The fence structure of claim 1 wherein said posts are of rectangular cross section.

3. The fence structure of claim 1 wherein said vertical slots are of "T" cross section.

4. The fence structure of claim 1 wherein said guide means are roller guides which engage the opposing sides of said vertical slots.

5. The fence structure of claim 1 wherein one of the extending top sides of each of said panels respectively overlaps the extending top side of the adjacent panel and the other extending top side of the panel is overlapped by the extending top side of the panel adjacent thereto, at least one panel in said fence structure having neither of its extending top members overlapped by an adjacent top member and secured by a removable pin which passes through the open slotted top portion of the last post in horizontal engagement with the extending top side of the panel which is disposed within said slotted top portion of the post to prevent the panel from being raised.

6. The fence structure of claim 5 wherein said panel whose top extensions are not overlapped is the last panel at one end of the structure.

7. The fence structure of claim 5 wherein said panel whose top extensions are not overlapped has a top piece with both extending portions thereof overlapping the respective extending members of the adjacent panels.

* * * * *